US011231259B2

(12) United States Patent
Thuman et al.

(10) Patent No.: US 11,231,259 B2
(45) Date of Patent: Jan. 25, 2022

(54) PROJECTILE WITH SELECTABLE ANGLE OF ATTACK

(71) Applicant: BAE SYSTEMS BOFORS AB, Karlskoga (SE)

(72) Inventors: Christer Thuman, Karlskoga (SE); Thomas Pettersson, Karlskoga (SE); Mats Larsson, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 192 days.

(21) Appl. No.: 16/608,040

(22) PCT Filed: Apr. 27, 2018

(86) PCT No.: PCT/SE2018/050440
§ 371 (c)(1),
(2) Date: Oct. 24, 2019

(87) PCT Pub. No.: WO2018/199843
PCT Pub. Date: Nov. 1, 2018

(65) Prior Publication Data

US 2020/0191537 A1 Jun. 18, 2020

(30) Foreign Application Priority Data

Apr. 28, 2017 (SE) ..... 1700079-5

(51) Int. Cl.
*F42B 10/66* (2006.01)
*F42B 12/20* (2006.01)
*F42B 12/32* (2006.01)

(52) U.S. Cl.
CPC ..... *F42B 10/661* (2013.01); *F42B 12/202* (2013.01); *F42B 12/32* (2013.01)

(58) Field of Classification Search
CPC ..... F42B 12/202; F42B 12/32; F42B 30/006; F42B 10/661; F42B 10/66; F42B 10/663;
(Continued)

(56) References Cited

U.S. PATENT DOCUMENTS 3,645,475 A * 2/1972 Stripling ..... F42B 10/66 244/3.22
3,749,334 A * 7/1973 McCorkle, Jr. ..... F42B 10/66 244/3.22

(Continued)

FOREIGN PATENT DOCUMENTS

DE 19509346 A1 9/1996
FR 2425049 A1 11/1979

(Continued)

OTHER PUBLICATIONS

Swedish Official Action including International-Type Search Report (dated Nov. 24, 2017) for corresponding Swedish App. 1700079-5.

(Continued)

*Primary Examiner* — John Cooper
(74) *Attorney, Agent, or Firm* — WRB-IP LLP

(57) ABSTRACT

A projectile with selectable angle of attack for increased impact on a target includes an active charge and controllable initiation device for initiation of the active charge, wherein the projectile also includes at least one side-acting impulse motor for tilting the projectile relative to its trajectory from a substantially vertical position, in which the front face of the projectile is directed toward the target, into a more horizontal position, in which the outer surface of the projectile is directed toward the target.

11 Claims, 2 Drawing Sheets

(58) Field of Classification Search
CPC ..... F41G 7/22; F41G 7/222; F41G 7/2246; F41G 7/006; F41G 7/20; F41G 7/2213; F41G 9/025; F41G 9/02
USPC ..... 244/3.15; 102/202.5
See application file for complete search history.

(56) References Cited

U.S. PATENT DOCUMENTS

| | | | | |
|---|---|---|---|---|
| 4,533,094 | A * | 8/1985 | Geis | F41G 7/2213 244/3.22 |
| 4,568,040 | A * | 2/1986 | Metz | F41G 7/222 244/3.22 |
| 4,892,268 | A * | 1/1990 | Peretti | B64D 1/04 102/384 |
| 4,923,142 | A | 5/1990 | Creusot et al. | |
| 5,123,612 | A | 6/1992 | Labroche et al. | |
| 2009/0145996 | A1 | 6/2009 | Gundel et al. | |
| 2014/0061364 | A1 | 3/2014 | Strassman et al. | |

FOREIGN PATENT DOCUMENTS

| | | | | |
|---|---|---|---|---|
| GB | 2002885 | A | 2/1979 | |
| SE | 533045 | C2 | 3/2010 | |
| WO | WO-9930105 | A1 * | 6/1999 | F42B 10/661 |

OTHER PUBLICATIONS

Internationa Search Report (dated Jun. 26, 2018) for corresponding International App. PCT/SE2018/050440.

* cited by examiner a)

b)

c)

PROJECTILE WITH SELECTABLE ANGLE OF ATTACK

BACKGROUND AND SUMMARY

The present invention relates to a projectile with selectable angle of attack for increased impact on a target.

Mortars are used for indirect fire against targets which very often are not visible from the gun position. Likewise, mortars are a suitable choice if a target is in some way protected/blocked from the sides, or for various reasons is not penetrable from the side, but is more accessible from above. For instance, targets within an enclosure/wall, sunken targets, etc., can be cited.

Mortars exist in a large number of designs and with different calibers, most common being mortars in the calibers 8 or 12 cm, which are manually handled by a crew. Mortars can also be mounted on a stand or vehicle. The projectile which is launched from a mortar, for instance a shell-action shell (mortar shell), hits its target from above with tip first substantially perpendicular to the target. Most mortar shells are naturally fragmenting and have an all-round strike capability, which means that, upon detonation, splinters are mainly thrown out sideways, which does not have any major effect on, for instance vehicle roofs, concealed or lying targets.

The strength of mortars lies in their simple construction, low price and low weight. The weak aspects are primarily short firing range and little effect of the individual shot.

The projectiles which are today designed to solve to some extent the problems which are described above are significantly more technically advanced, significantly more costly and are usually used for a different type of situation and target.

For instance, there are projectiles with forward-directed ball plates, which eject balls/projectiles in the direction of travel of the shell, i.e. down toward the ground.

A further example is fin-stabilized artillery shells. They have control surfaces and fins and are guided with GPS technology, which makes them extremely accurate.

The shell is usually discharged with a howitzer and flies very high, maximally to about 15,000 meters, and at this height the wings are then deployed and the shell begins to glide toward the target. In the last bit, the shell falls almost vertically, which in this case optimizes the effect. In the case of long firing ranges, the maneuverability (diving capability) is, however, limited, which means that the angle of the shell upon detonation is not optimal.

In summary, there is a need for a method for being able to choose and control an angle of attack of a projectile in order to increase the effect. There is also a need for less costly projectiles, for instance mortar shells, with better impact on targets which are poorly accessible with balls/splinters having an all-round strike capability.

It is desirable to provide a projectile having increased impact on semi-hard targets compared with the projectiles which are used today.

The present projectile, according to an aspect thereof comprises a nose portion, a casing portion and a fin portion. The projectile further comprises an active part, a first initiation device, a sensor, at least one nozzle, a control computer, at least one impulse motor and a second initiation device.

The first initiation device initiates said at least one impulse motor. The second initiation device initiates an active part.

In a further embodiment, the projectile comprises a sensor in the form of a distance sensor. The distance sensor is used to measure the distance between the projectile and the target. The distance sensor can be, for instance, a height sensor.

The side-acting impulse motor tilts the projectile from one position into another position. For instance, the projectile is tilted substantially from a vertical position, in which the front face of the projectile is directed toward the target, into a substantially horizontal position, in which the outer surface is directed toward the target.

In one embodiment, the first initiation device can be initiated via the distance sensor.

In a further embodiment, the at least one side-acting impulse motor of the projectile is disposed on that side of the projectile which is adjacent to the front of the projectile.

In another embodiment, said at least one side-acting impulse motor is driven, for instance, by a powder charge.

In a further embodiment of the projectile, the impulse motor is pyrotechnical.

In one embodiment, the projectile also comprises at least one gyro.

In a further embodiment, the projectile comprises a single-axis gyro. The single-axis gyro is used to determine the angle of rotation of the projectile.

In another embodiment, said gyro is multi-axis.

In one embodiment, the active part is prefragmented with balls. In another embodiment, the active charge part is prefragmented with cubes, hexagons or disks.

The fragments of the active part can be disposed on one side of the outer surface of the projectile, preferably on the same side as the at least one nozzle.

In a further embodiment, the second initiation device can be initiated, for instance, via the single-axis gyro. In another embodiment, the second initiation device is initiated by a multi-axis gyro.

In another embodiment of the projectile, the active part of the second initiation device is initiated when the gyro signals a second angle relative to the first angle of around 90°. In another embodiment of the projectile, the active part is initiated when the gyro signals a second angle relative to the first angle within a range of 60-120°.

In another embodiment, the active part can be configured as a projectile-forming, directional explosive action.

The active part of the projectile can in another embodiment be prefragmented with balls, cubes, hexagons or disks made of heavy metal or steel.

In another embodiment, the projectile comprises a GPS unit.

In a further embodiment, the first initiation device can be initiated via the GPS unit.

In fin-stabilized projectiles, a multi-axis gyro can be used in combination with a plurality of impulse motors to orient the projectile relative to the vertical line/horizontal plane, so that the projectile acquires a, from the effect aspect, advantageous position at the moment of detonation. If the angle of descent of the projectile is shallow, the impulse motors on one side of the projectile are activated, so that the projectile assumes a more vertical position. One embodiment of fin-stabilized projectiles therefore comprises a plurality of impulse motors.

Another example is fin-stabilized projectiles of medium-caliber or greater caliber for direct fire. One or more impulse motors can then be utilized to rotate the projectile into any chosen angle prior to detonation.

In a further embodiment, the projectile comprises two selectable active parts for action according to two action modes, via a smaller active part disposed behind the front face of the shell and/or via a larger active part disposed behind the outer surface of the shell.

A further object of the present invention is to provide a method for tilting or choosing the angle of attack of a projectile as described above in connection with a target.

A method for choosing the angle of attack of a projectile, as is defined above, over a target comprises, for instance:

measuring the distance to the target with a height sensor, starting a chosen impulse motor, wherein the projectile rotates in relation to its path, and initiating the active part.

Other sensors or means can be used to initiate the first impulse motor.

In another embodiment, the method comprises:

setting the first angle signal of a gyro (5) to 0° at a predetermined distance to the target, and a second angle signal to the desired change of angle over a target, measuring the distance to the target with a height sensor (4), starting a chosen impulse motor (3), wherein the projectile rotates in relation to its path, and initiating the active part (1) when the gyro signals the second, predetermined angle.

The second, predetermined angle depends on the projectile type.

In a further embodiment for choosing the angle of attack of a projectile over a desired target, comprises:

setting the first angle signal of a gyro to 0° at a predetermined distance to the target, and a second angle signal to the desired change of angle over a target, measuring the distance to the target with a height sensor, starting the impulse motor, wherein a first force direction results in rotation of the projectile in relation to its trajectory, initiating the active part when the gyro signals the second, predetermined angle, at which point the outer surface of the projectile is exposed to the target.

The active part is initiated, for example, when the gyro signals a second angle relative to the first angle of around 90°.

The second, predetermined angle relative to the first angle can be freely chosen in other embodiments.

The second, predetermined angle varies relative to the first angle within a range of 1-120°.

The second, predetermined angle varies relative to the first angle within a range of 1-60°.

The second, predetermined angle varies relative to the first angle within a range of 60-120°.

In order that a mortar projectile in 120 mm caliber shall be able to rotate sufficiently far and expose the outer surface to a target according to the above, an impulse within the range 20-150 Ns is required.

For lesser rotations in the lateral direction, a smaller impulse is required.

In other embodiments, the nose of the projectile is exposed to the target.

Further advantages and effects of the invention will emerge from the detailed description of the invention.

BRIEF DESCRIPTION OF DRAWINGS

The invention will now be described, by way of example, with reference to the appended drawings, in which.

DETAILED DESCRIPTION

Before the invention is disclosed and described in detail, it should be understood that this invention is not limited to specific materials or configurations described herein, but rather configurations and materials can vary. It should also be understood that the terminology applied herein is used only to describe specific embodiments and is not intended to be limiting, but rather the scope of the present invention is limited only by the appended claims.

In the present description, the term projectile relates to an object which is fired from a weapon or launched with a weapon. A shell is a projectile which contains an explosive charge or other type of active part.

In the present description, the term projectile is used to illustrate a projectile with the aim of hitting a target from above. The angle can be oblique.

The targets are described as being semi-hard, but the method is applicable also to other targets.

The targets for medium-caliber ammunition are described as being all types of armored targets apart from tank fronts, i.e. targets with armor protection equivalent to from about 10 to 200 mm armor steel. These projectiles are subcaliber and fin-stabilized, having a penetrator made of heavy metal or depleted uranium, which are fired at velocities between 1,200 and 1,600 m/s. The notation for this type of projectile is APFSDS ("Armor Piercing, Fin Stabilised, Discarding Sabot"). Large-caliber projectiles are mainly intended for combat against a tank front.

Figure 1:
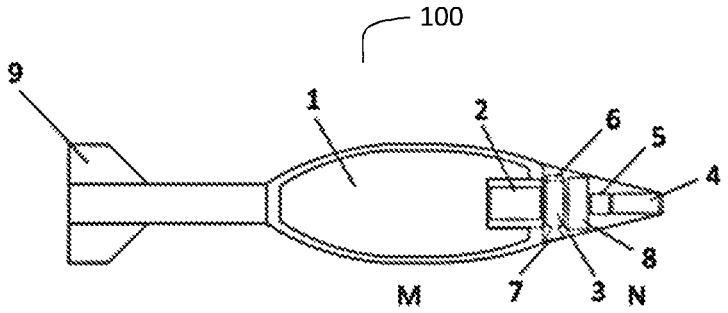
FIG. 1 shows schematically a longitudinal section of a projectile.

FIG. 1 shows a schematic longitudinal section of a projectile. The projectile 100 comprises an active part 1 with an associated initiation device 2, and at least one impulse motor 3 with an associated initiation device 6. Said at least one impulse motor 3 of the projectile is disposed on that side of the projectile which is adjacent to the front of the projectile.

Said at least one side-acting impulse motor 3 can be driven, for instance, by a powder charge.

The projectile also comprises a height sensor 4, together with at least one gyro device 5.

The projectile comprises a first initiation device 6 for activating said at least one impulse motor 3.

The impulse motor 3 and the first initiation device 6 can be initiated via the height sensor 4.

The impulse motor 3 can in one embodiment be initiated via a GPS unit.

The impulse motor 3 can be pyrotechnical.

The first initiation device 6 is in one embodiment remote controlled via a GPS unit.

The second initiation device 6 is in one embodiment remote controlled via a GPS unit.

The active part 1 can be configured with a non-circular cross section with the aim of achieving best possible splinter ejection angles once the projectile has been rotated through 90 degrees in relation to the path tangent. The active part 1 can be configured as a projectile-forming, directional explosive action.

The active part 1 can also comprise two smaller, oppositely directed active charge parts disposed behind the outer surface.

The active part 1 can also be prefragmented with balls, cubes, hexagons or disks made of heavy metal or steel.

Figure 2:
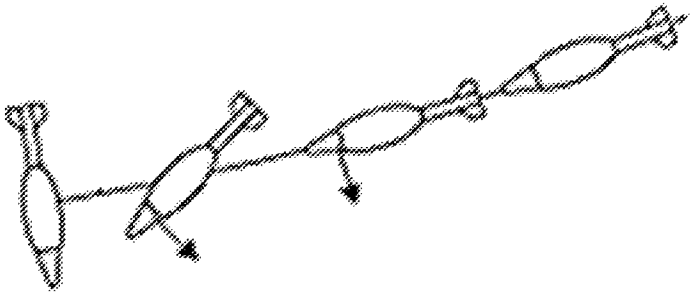
FIG. 2 shows a schematic sequence of the tilting of a projectile during the final phase of the projectile.

A method for tilting the projectile 100 over a desired target, for instance the ground, is illustrated in FIG. 2. The method comprises the first angle signal of a gyro 5 being set to 00 at a predetermined distance to the target, and a second angle signal being set to the desired change of angle over the target. The distance to the target is measured, for instance, with a height sensor 4, and at a defined height the impulse motor 3 is started and the shell is rotated in relation to its path. The active part 1 is initiated when the gyro 5 signals the second, predetermined angle, whereupon the outer surface of the projectile is exposed to the target.

In a first action mode, the projectile is tilted, for instance, to about 90° relative to its trajectory, preferably, with the aid of one or more side-acting impulse motor(s) disposed on that side of the projectile which is adjacent to the nose of the projectile. The simplest embodiment of the current projectile does not have equipment to identify/analyze targets, since this involves an increased cost. In another embodiment, sensors can be used during the final phase for identification of the target object and/or for distance measurement. Preferably, a height sensor is used for the distance measurement between the shell and the target. At a suitable distance from the target, one or more side-acting impulse motor(s) is/are initiated. A impulse motor, preferably a solid-propellant motor which produces sufficient force for rotation of the projectile through about 90 degrees relative to the trajectory, is chosen. For 120 mm mortar shells, the impulse should lie within the range 20-150 Ns.

Examples of solid propellant are nitrocellulose-based (one, two, triple or multibased) or composite powders. Following an executed tilt, an active part in the projectile is initiated via an activation device and an initiation device. The initiation device is, preferably, pyrotechnical and of known type and is not described in closer detail in the continued text.

In order to compensate for uncertainties in the angle of rotation of the projectile/shell, for example due to cold or warm impulse motor, one or more gyro devices, preferably, is/are used. The function of the gyro is to measure the change of angle of the shell after the impulse motor has been started. Before the impulse motor is started, the angle signal of the gyro is set to 0 degrees. The impulse motor is started, and when the gyro reports 90 degrees the initiation of the active part takes place. The angle varies, however, and an angle between 60-120 degrees is quite likely achieved. An angle between 70-110 or 80-100 degrees is more advantageous and an angle of around 90 degrees is the ideal scenario. Once the balls and splinters of the shell have a certain dispersion, an effect is not lacking if the angle deviates somewhat from 90 degrees.

Because it is known about which axis, fixed to the body, the rotation of the projectile occurs, a single-axis gyro for the above projectile should suffice. In the basic design of the projectile, it is unknown, however, in which direction the nozzle of the impulse motor is pointing in the tilting, but if a 90-degree maneuver is made this is immaterial.

The projectile has the same side toward the target as that on which the nozzle belonging to the impulse motor is seated. This means that it is sufficient to place balls on one side of the casing, i.e. on the same side as that on which the nozzle is seated. A drawback with this can be that if, in a second action mode, it is intended to fight a detachment, it might be wished not to tilt the shell at all, but instead to activate the scything action of the projectile.

In one embodiment, a curved ball cup can on one (exposed) side be utilized to optimize the ball dispersion.

Furthermore, it can be the case that, in combat against a detachment, it might be possible to make do with natural fragmentation, i.e. it does not very much matter that there are balls only on one side of the shell.

In a further action design (dual purpose), there are arranged small balls on one side and large balls on the other side.

In summary, the current invention results in an increased impact on a target and a reduced risk area, since no balls are thrown upward.

The proposed principle of tilting a projectile or shell is also applicable to a flying bomb or to a fin-stabilized shell for use against aerial targets or against surface targets on land and at sea. For these, a plurality of impulse motors are usually required in order to be able to initiate an impulse on the correct side of the projectile in order to adjust it in the correct direction in relation to the target. The multi-axis gyro keeps track of the position of the projectile, so that an impulse is initiated on the correct side in order to adjust the selectable angle.

One example is guided, fin-stabilized artillery shells. They have control surfaces and fins and are guided with GPS technology, which makes them extremely accurate. The shell is usually discharged with a howitzer and flies very high, maximally to about 15,000 meters, and at this height the wings are then deployed and the shell begins to glide toward the target. In the last bit, the shell falls almost vertically, which in this case optimizes the impact on certain target types which are vulnerable to scything splinter effect, unlike the version described for mortar shells, in which the shell is instead rotated in order to optimize the impact on targets which are vulnerable to downwardly directed splinters.

In those cases in which the maneuverability of a guided shell is not sufficient to attain a vertical detonation position at the end of the path, the effect can be improved if the shell has the capacity to right itself or be set at any chosen angle in relation to the target. The angular adjustment would then be less than for mortar shells, since a smaller angular adjustment is required in order to set the shell vertical.

Shells having high precision but poor maneuverability would obtain a significantly better effect with the current invention by attaining, with impulse motors, a desired detonation position.

Figure 3:
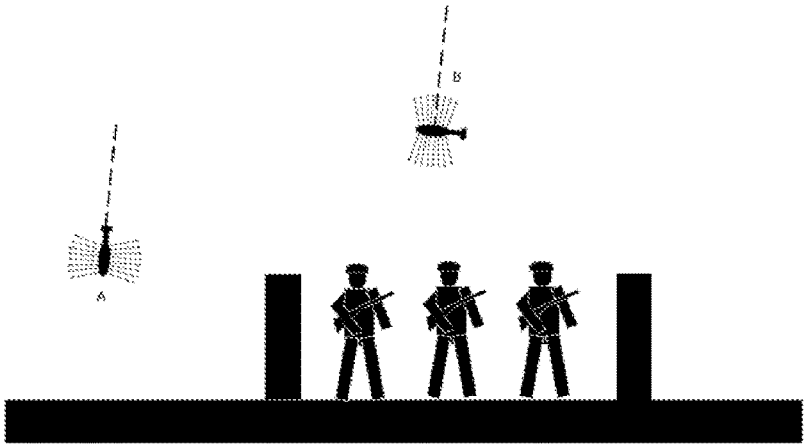
FIG. 3*a-c* show different examples of how the projectile (B) relates to various target situations compared with the prior art (A).
Figure 3:
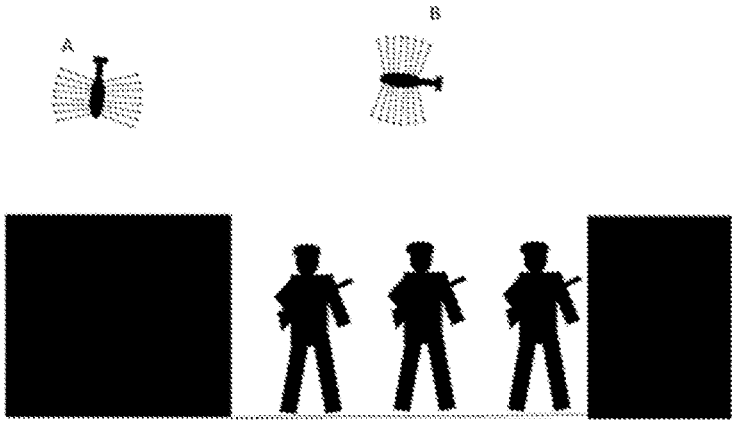
Figure 3:
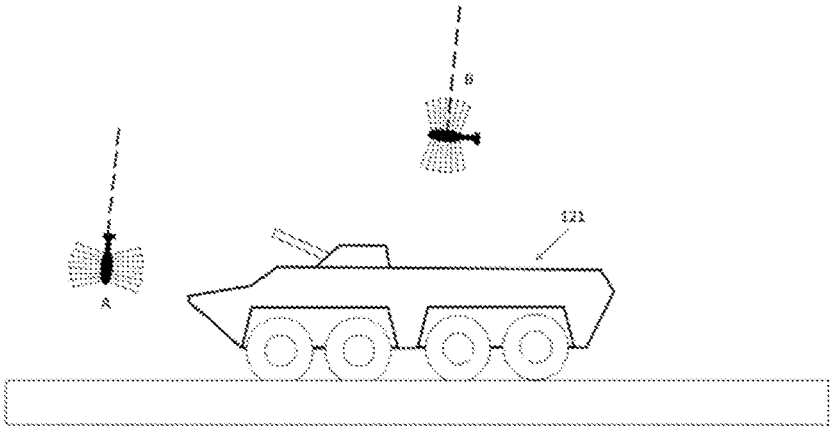

FIG. 3 *a-c* illustrate different possible methods showing how the invention B solves the problem of insufficient splinter effect for modern-day projectiles A in combat against a target with side protection by tilting the shell during its final phase, so that splinters are directed downward toward the target (see the direction of the arrows from the shell B).

FIG. 3*a* illustrates a situation where a detachment is protected by side walls, for example. FIG. 3*b* shows a similar situation, but in which the target is located in a basin, for example a bunker. FIG. 3*c* shows how the tilted shell B effectively directs its action toward a vehicle from above. The roof 121 often consists of or comprises thinner material than the sides of the vehicle and is therefore a suitable target. In all the figures it is shown how the splinter pattern differs between shell A and B in the different situations, in which B has impact on the target in the vertical direction, while A has its impact on the target in the horizontal direction. The splinter pattern is illustrated by the arrows from the respective shell.

The method of tilting the projectile above the target in order to increase the splinter impact on sensitive targets such as vehicle roofs and pickets protected at the side by, for example, sandbags, walls, bunkers (see FIG. 3*a-c*) can also be applied to other projectiles, flying bombs or fin-stabilized shells which are used against other targets.

The invention claimed is:

1. A projectile comprising a front nose portion, a rear portion comprising a fin portion, a casing portion comprising an active part disposed between the nose portion and the rear portion, the nose portion comprising:

a sensor, a first initiation device and an associated at least one impulse motor, the first initiation device and the impulse motor being initiated by the sensor in order to tilt the projectile, a nozzle, a control computer, and a second initiation device adjacent to and for initiating the active part disposed in the casing, wherein the projectile also comprises at least one gyro for initiating the second initiation device and the active part over a target.

2. The projectile as claimed in claim 1, in which the at least one impulse motor is driven by a powder charge.

3. The projectile according to claim 1, in which the sensor is a height sensor.

4. The projectile as claimed in claim 1, in which the impulse motor is pyrotechnical.

5. The projectile as claimed in claim 1, in which the active part charge comprises balls.

6. The projectile as claimed in claim 1, in which the active part is disposed on one side of the casing portion of the projectile, preferably on the same side of the projectile as that on which the at least one nozzle is arranged in the nose portion.

7. The projectile as claimed in claim 1, in which the active part is configured as a projectile-forming, directional explosive action.

8. The projectile as claimed in claim 1, in which the active part is prefragmented with balls, cubes, hexagons or disks made of heavy metal or steel.

9. A method for choosing the angle of attack of a projectile defined according to claim 1 over a target, the method comprising:

setting the first angle signal of a gyro to 0° at a predetermined distance to the target, and a second angle signal to the desired change of angle over the target, measuring the distance to the target with a height sensor, starting a chosen impulse motor at a defined height, wherein the projectile rotates horizontally in relation to its path, and initiating the active part when the gyro signals the second, predetermined angle.

10. The method as claimed in claim 9, wherein the second angle relative to the first angle is selectable.

11. The method as claimed in claim 10, wherein the active part is initiated when the gyro signals a second angle relative to the first angle of around 90°.

* * * * *